US008348140B2

(12) United States Patent
Maier-Hunke

(10) Patent No.: US 8,348,140 B2
(45) Date of Patent: Jan. 8, 2013

(54) CLIP FILE

(75) Inventor: Horst-Werner Maier-Hunke, Iserlohn (DE)

(73) Assignee: Durable Hunke & Jochheim GmbH & Co. KG, Iserlohn (DE)

( * ) Notice: Subject to any disclaimer, the term of this patent is extended or adjusted under 35 U.S.C. 154(b) by 576 days.

(21) Appl. No.: 12/312,664

(22) PCT Filed: Oct. 23, 2007

(86) PCT No.: PCT/EP2007/009163

§ 371 (c)(1),
(2), (4) Date: Mar. 10, 2010

(87) PCT Pub. No.: WO2008/064749

PCT Pub. Date: Jun. 5, 2008

(65) Prior Publication Data

US 2010/0276477 A1 Nov. 4, 2010

(30) Foreign Application Priority Data

Nov. 27, 2006 (DE) ..... 10 2006 056 534

(51) Int. Cl.
*B65D 27/00* (2006.01)
*B42D 3/00* (2006.01)
*B42D 7/00* (2006.01)

(52) U.S. Cl. ..... 229/67.1; 281/45

(58) Field of Classification Search ..... 229/67.1; 281/45

See application file for complete search history.

(56) References Cited

U.S. PATENT DOCUMENTS

| | | | | | |
|---|---|---|---|---|---|
| 470,824 | A | * | 3/1892 | Huewe | 24/67.5 |
| 549,660 | A | * | 11/1895 | Rodden | 24/67.3 |
| 1,783,678 | A | * | 12/1930 | Shaw | 24/539 |
| 3,099,269 | A | * | 7/1963 | Sorensen | 24/67.11 |
| D242,431 | S | * | 11/1976 | Carroll | D20/43 |
| 4,137,658 | A | * | 2/1979 | Wos | 40/641 |
| 4,883,397 | A | * | 11/1989 | Dubost | 411/174 |
| 4,904,104 | A | * | 2/1990 | Gloeckle | 402/80 R |
| 5,249,336 | A | | 10/1993 | Miller | |
| 5,285,952 | A | * | 2/1994 | Ho | 229/67.4 |
| 5,555,606 | A | * | 9/1996 | Chu | 24/67.9 |
| 5,765,873 | A | * | 6/1998 | Chen | 281/45 |
| 6,139,064 | A | * | 10/2000 | Maier-Hunke | 281/45 |
| 2004/0238606 | A1 | * | 12/2004 | Su | 229/67.1 |

FOREIGN PATENT DOCUMENTS

| | | |
|---|---|---|
| AT | 239 753 B | 4/1965 |
| DE | 20 60 306 A1 | 8/1972 |
| EP | 1 048 484 B | 3/2004 |

* cited by examiner

*Primary Examiner* — Nathan J Newhouse
*Assistant Examiner* — Derek Battisti
(74) *Attorney, Agent, or Firm* — Mark P. Stone

(57) ABSTRACT

The invention relates to a clip file, comprising a clip body with a front and a rear clip jaw (5) made from sheet steel, wherein both clip jaws (5) are connected by means of a yoke and the rear clip jaw rests against a rear wall of a rear cover of the file, while the front clip jaw (5) presses against a section of a multiply folded strip (2), provided with a window (4), formed from the longitudinal edge of the rear cover folded towards the front of the file and the strip (2) forms a stop which cooperates with a counter stop formed from an edge of the front clip jaw (5) folded inwards. According to the invention, the clip body may be provided with a defined grip point by means of a projection embossed in the center of at least the front clip jaw, the apex of which faces the yoke of the clip body.

20 Claims, 5 Drawing Sheets

CLIP FILE

Figure 1:
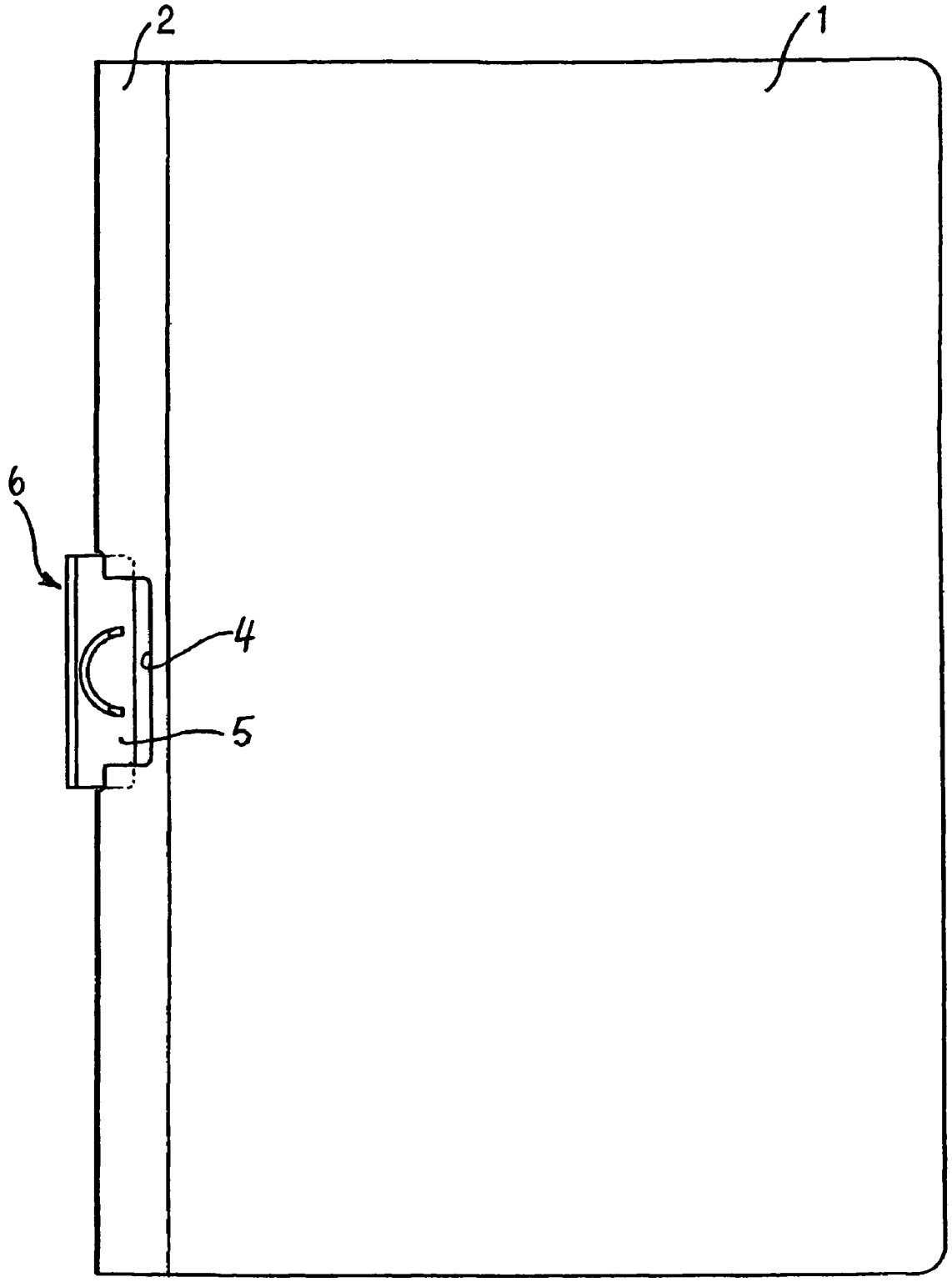

The invention relates to a clip file with a clip member of sheet steel for clamping sheet material, comprising a front clip leg and a rear clip leg connected thereto by means of a yoke, wherein the rear clip leg of the clip member rests against the rear wall of the rear cover of the file, whilst the front clip leg of the clip member presses against a section of a multiply folded strip provided with a window, formed from the longitudinal edge of the rear cover of the file bent towards the front of the file, and the multiply folded strip of the clip file forms a stop which cooperates with a counter stop formed from an edge of the front clip leg of the clip member bent over and protruding inside the clip member.

Clip files of the type mentioned above are known e. g. from DE-A 37 18 664, DE-OS 18 04 237 and EP-A 0 576 11. The clip members used therein and consisting of sheet steel have plane or slightly concave clip legs with smooth grip surfaces. The smooth grip surfaces are not satisfying in so far as they let the user freely choose the location where he grips the clip member with the thumb and the index finger of his hand. Depending on the type of the mounting of the clip member in the respective clip file, this can result in more or less severe cants and difficulties resulting herefrom when actuating the respective clip member.

In order to spare the user of clip files the indicated difficulties, in a clip file known from DE-U 92 17 203, a clip member consisting of plastics is provided with a roughened surface in its central area, which, however, practically only optically defines a grip location. A clip file where the grip location is definitively given to the user by the shape of the clip member is known from EP-B 1 048 484. In this file, the outer sides of the clip legs of a clip member also consisting of plastics are provided with a central grip hollow for the thumb tip and a fingertip. When considering the clip member according to EP-B 1 048 484, it will be obvious that the realization of a given grip location was only possible here due to the embodiment of the clip member as molded plastics part.

The object underlying the invention is a clip file with a clip member consisting of sheet steel to provide the clip member with a defined grip location. This object is achieved according to the invention in that a bead protruding to the outside and essentially having the shape of a semicircle is embossed in the center of at least the front clip leg of the clip member, the apex of the bead facing the yoke of the clip member.

Two advantages are achieved by the claimed embodiment of the bead, the first advantage is that the grip surface can be designed sufficiently large, even with the clip legs being comparatively narrow. The second advantage is that the bead is not embodied continuously, i. e. as a full circle; this ensures that, in contrast to the area of the bead, there is no change of the cross-section of the sheet metal in the bead-free area of the clip leg. In other words, the grip location is connected to the remaining surface of the clip leg via an unweakened bridge.

Practically, the front as well as the rear clip legs of the clip member are provided with a bead defining the grip location.

It proves to be particularly advantageous for the yoke of the clip member to be embodied in the form of a gable roof, as the longitudinal edges of the yoke facing away from the apex of the yoke form web shaped protrusions additionally increasing the grip of the clip member together with the apex areas of the beads.

The ends of the bead of the clip member defining the grip surface should pass over into the surface of the respective clip leg so as to run down in a beveled manner to avoid damages to an edge of the window of the multiply folded strip of the file gripped under by the clip member.

Figure 2:
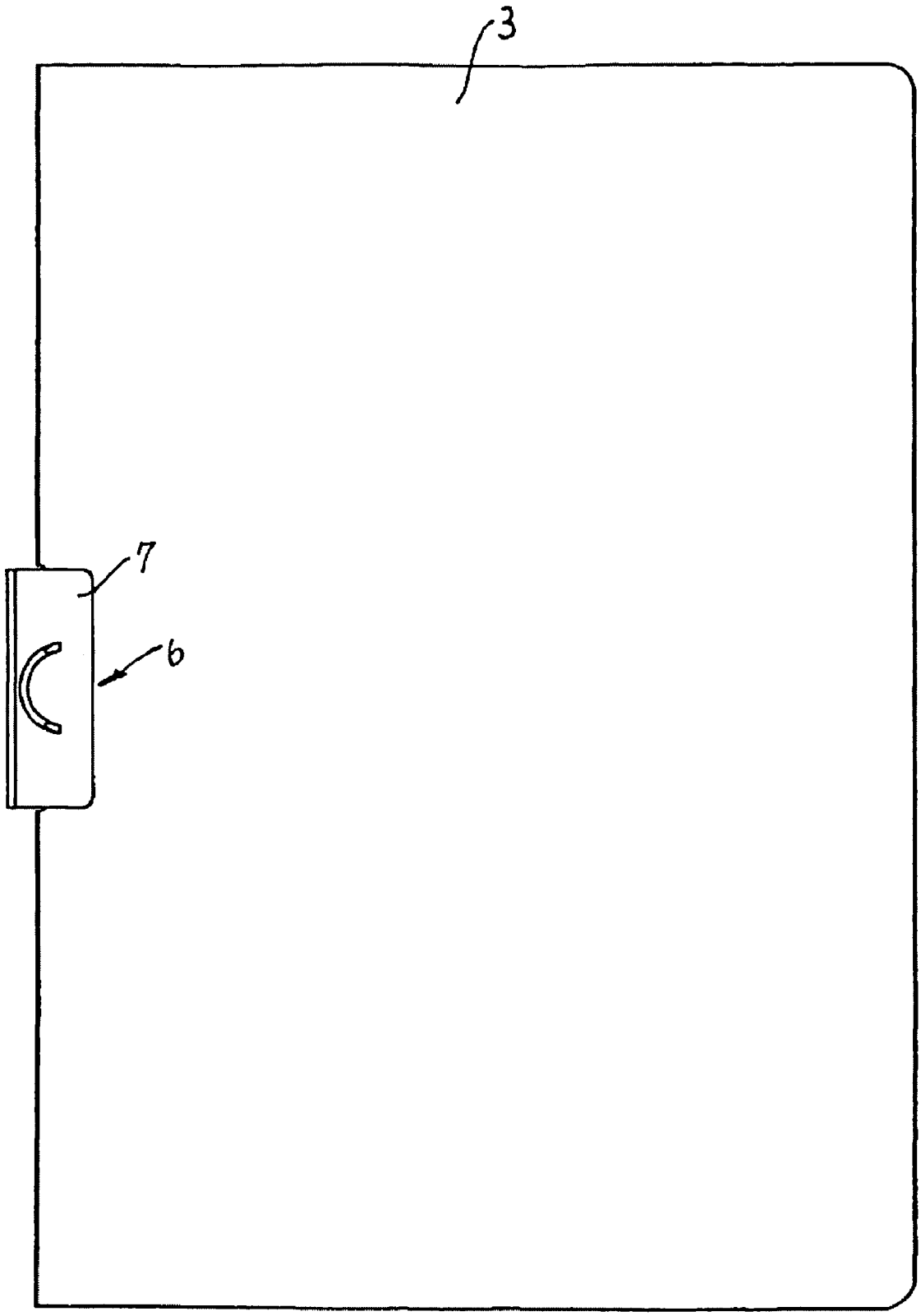
Figure 3:
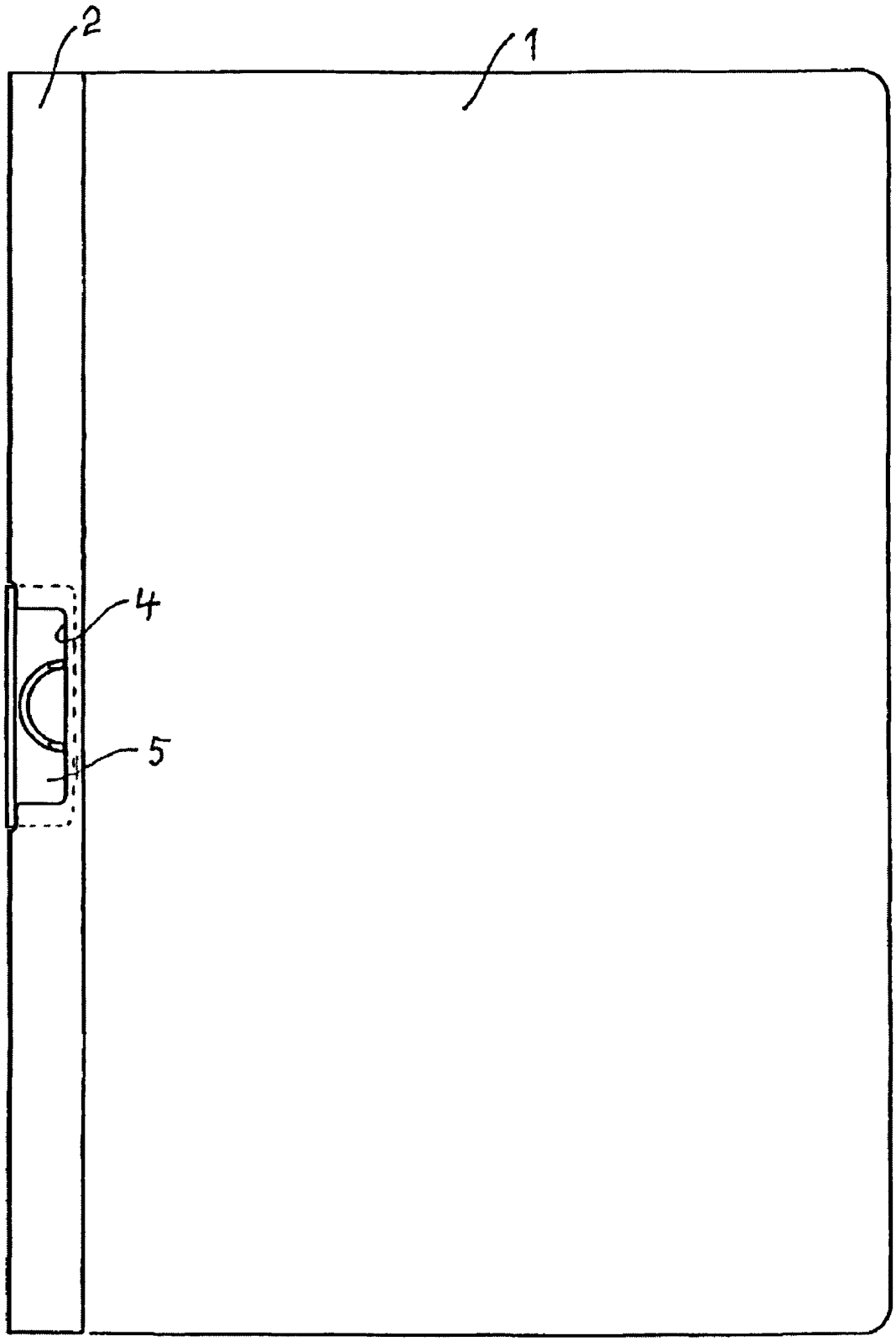
Figure 4:
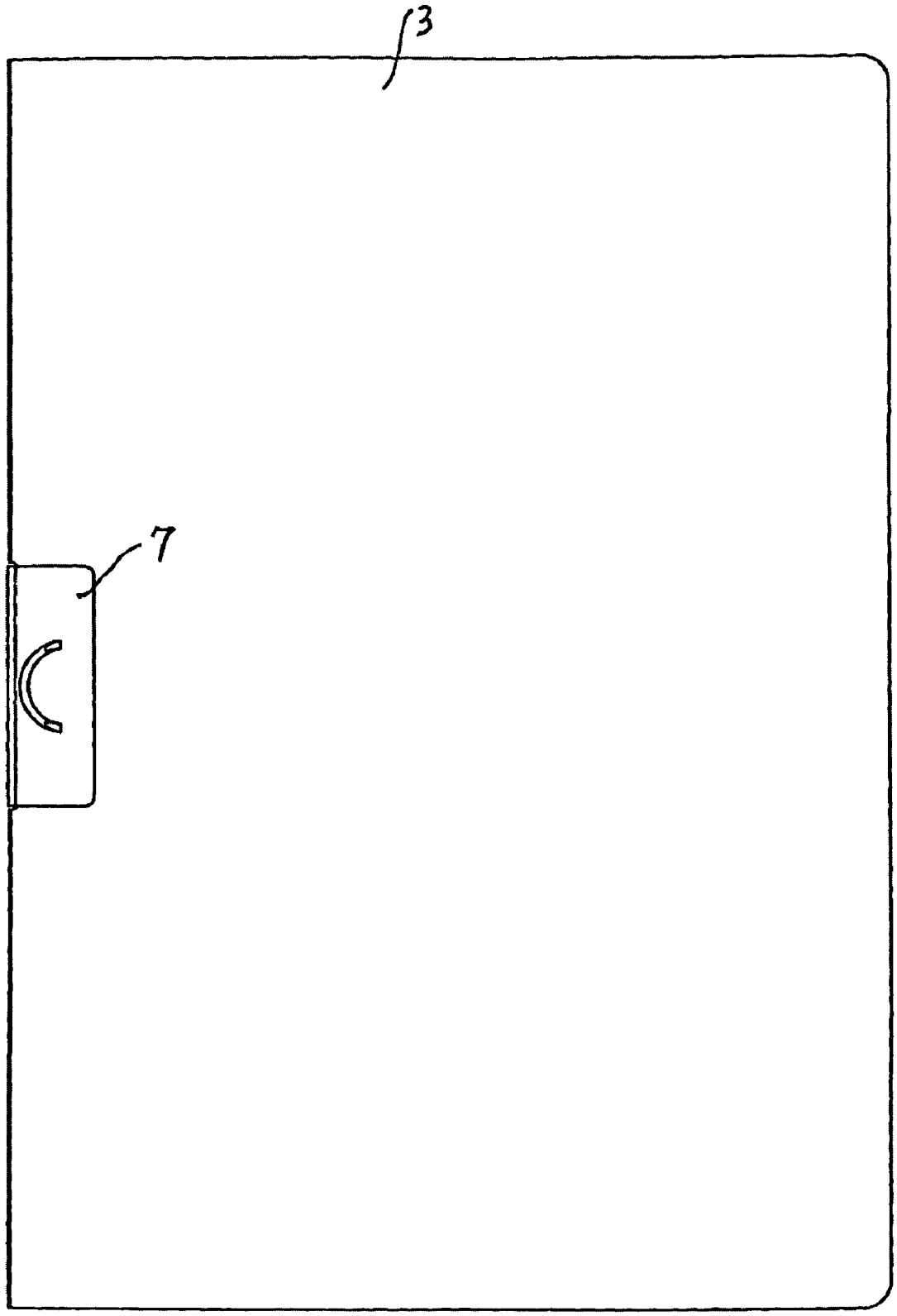
Figure 5:
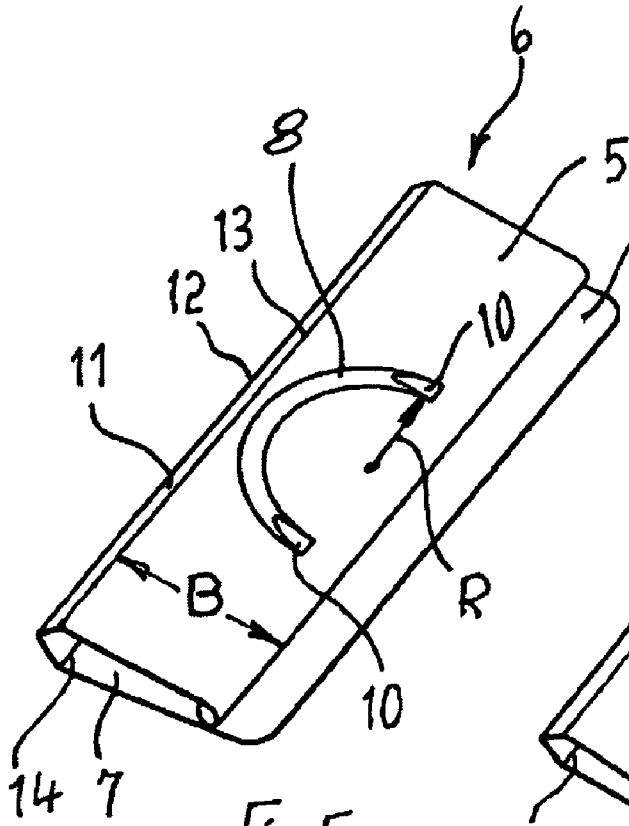

In the following, one embodiment of the invention will be illustrated in more detail with reference to the enclosed drawings. In the drawings:

FIG. 1 shows the front side of a clip file with the clip member being removed from the clamping position, FIG. 2 shows the back of the clip file in the position of the clip member shown in FIG. 1, FIG. 3 shows the front side of the clip file represented in FIGS. 1 and 2 with the clip member being transferred into the clamping position, FIG. 4 shows the back of the clip file in the position of the clip member shown in FIG. 3, FIG. 5 shows, in an enlarged scale compared to FIGS. 1 to 4, the perspective front view of the clip member used in the clip file according to FIGS. 1 to 4, and FIG. 6 shows the rear view of the clip member according to FIG. 5.

In the Figures, 1 is the front cover of a clip file that regularly consists of a transparent foil section of which one longitudinal edge is connected to a multiply folded strip 2 by a weld, the strip being formed by a longitudinal edge of the rear cover 3 regularly formed of a not transparent foil section folded towards the front side of the clip file. The multiply folded strip 2 comprises a window 4 through which the front clip leg 5 of a clip member 6 made by bending a sheet metal blank protrudes inside the multiply folded strip 2. The rear clip leg 7 of the clip member rests against the back of the rear cover 3 of the clip file.

While FIGS. 1 and 2 show the clip member 6 in a position in which sheet material can be inserted into the clip file, FIGS. 3 and 4 show the conditions reached when the sheet material is clamped in.

Figure 6:
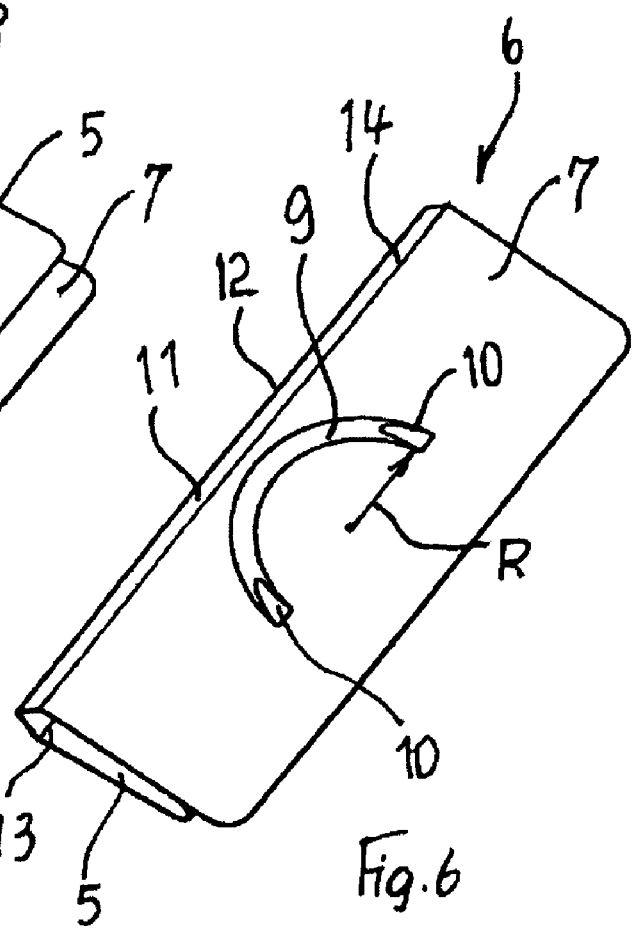

As can be seen in particular in FIGS. 5 and 6, the front clip leg 5 as well as the rear clip leg 7 of the clip member 6 are provided with a bead 8 or 9 protruding beyond the respective outer surface of the clip legs, the bead having the shape of a semicircle and being embossed into the sheet metal. The radius R of the semicircle formed by the beads 8, 9 is in practice approximately 10 mm in a clip member 6 of which the front clip leg 5 has a width B of ca. 15 mm.

The ends of the beads 8 and 9 pass over into the surface of the clip legs 5 and 7 via zones 10 that run down in a beveled manner.

The yoke 11 of the clip member 6 connecting the clip legs 5 and 7 with each other has the shape of a gable roof, so that the longitudinal edges 13 and 14 facing away from its apex 12 form additional grip edges.

The invention claimed is:

1. Clip file with a clip member (6) of sheet steel for clamping sheet material, comprising a front clip leg (5) and a rear clip leg (7) connected thereto by means of a yoke (11), wherein the rear clip leg (7) of the clip member (6) rests against the rear wall of the rear cover (3) of the file, whilst the front clip leg (5) of the clip member (6) presses against a section of a multiply folded strip (2) provided with a window (4), the strip being formed from the longitudinal edge of the rear cover (3) folded towards the front of the file, and the multiply folded strip (2) of the clip file forms a stop which cooperates with a counter stop formed from a bent edge of the front clip leg (5) of the clip member (6) protruding into the interior of the clip member (6), characterized in that a bead (8) protruding to the outside and essentially having the shape of a semicircle is embossed in the center of a least the front clip leg (5) of the clip member (6), the apex of the bead (8) facing the yoke (11) of the clip member (6).

2. Clip file according to claim 1, characterized in that a bead (9) protruding to the outside and essentially having the shape of a semicircle is embossed also in the center of the rear clip leg (7) of the clip member (6), the apex of the bead (9) facing the yoke (11) of the clip member (6).

3. Clip file according to claim 2, characterized in that the radius (R) of the semicircle formed by the respective bead (8, 9) is at least 5 mm.

4. Clip file according to claim 2, characterized in that the radius (R) of the semicircle formed by the respective bead (8, 9) is at least 10 mm.

5. Clip file according to claim 2, characterized in that the width (B) of the front clip leg (5) of the clip member (6) is smaller than the diameter of the semicircle.

6. Clip file according to claim 2, characterized in that the yoke (11) of the clip member (6) is designed to have the shape of a gable roof.

7. Clip file according to claim 2, characterized in that the ends of the respective bead (8, 9) pass over into the surface of the clip legs (5, 7) so as to run down in a beveled manner.

8. Clip file according to claim 1, characterized in that the radius (R) of the semicircle formed by the respective bead (8, 9) is at least 5 mm.

9. Clip file according to claim 8, characterized in that the radius (R) of the semicircle formed by the respective bead (8, 9) is at least 10 mm.

10. Clip file according to claim 8, characterized in that the width (B) of the front clip leg (5) of the clip member (6) is smaller than the diameter of the semicircle.

11. Clip file according to claim 8, characterized in that the yoke (11) of the clip member (6) is designed to have the shape of a gable roof.

12. Clip file according to claim 8, characterized in that the ends of the respective bead (8, 9) pass over into the surface of the clip legs (5, 7) so as to run down in a beveled manner.

13. Clip file according to claim 1, characterized in that the radius (R) of the semicircle formed by the respective bead (8, 9) is at least 10 mm.

14. Clip file according to claim 13, characterized in that the width (B) of the front clip leg (5) of the clip member (6) is smaller than the diameter of the semicircle.

15. Clip file according to claim 13, characterized in that the yoke (11) of the clip member (6) is designed to have the shape of a gable roof.

16. Clip file according to claim 13, characterized in that the ends of the respective bead (8, 9) pass over into the surface of the clip legs (5, 7) so as to run down in a beveled manner.

17. Clip file according to claim 1, characterized in that the width (B) of the front clip leg (5) of the clip member (6) is smaller than the diameter of the semicircle.

18. Clip file according to claim 17, characterized in that the yoke (11) of the clip member (6) is designed to have the shape of a gable roof.

19. Clip file according to claim 1, characterized in that the yoke (11) of the clip member (6) is designed to have the shape of a gable roof.

20. Clip file according to claim 1, characterized in that the ends of the respective bead (8, 9) pass over into the surface of the clip legs (5, 7) so as to run down in a beveled manner.

* * * * *